US008322168B2

(12) United States Patent
Wall et al.

(10) Patent No.: US 8,322,168 B2
(45) Date of Patent: Dec. 4, 2012

(54) LATERALLY-STRETCHABLE KNIT FABRIC

(75) Inventors: Steve Young Wall, Browns Summit, NC (US); Roger Tornero, Greensboro, NC (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 12/700,336

(22) Filed: Feb. 4, 2010

(65) Prior Publication Data

US 2010/0192638 A1 Aug. 5, 2010

Related U.S. Application Data

(60) Provisional application No. 61/149,938, filed on Feb. 4, 2009.

(51) Int. Cl.
*D04B 23/06* (2006.01)

(52) U.S. Cl. ..... 66/193; 66/195

(58) Field of Classification Search ..... 66/195, 66/193, 202; 442/305, 306, 313, 314
See application file for complete search history.

(56) References Cited

U.S. PATENT DOCUMENTS

| | | | | | |
|---|---|---|---|---|---|
| 2,153,645 | A * | 4/1939 | Schonfeld | 66/192 |
| 2,936,603 | A * | 5/1960 | Lewine | 66/193 |
| 3,552,155 | A * | 1/1971 | Hartung | 66/192 |
| 3,567,565 | A * | 3/1971 | Jones et al. | 28/102 |
| 3,570,482 | A * | 3/1971 | Emoto et al. | 602/76 |
| 3,625,029 | A * | 12/1971 | Safrit et al. | 66/142 |
| 3,656,324 | A * | 4/1972 | Jackson | 66/177 |
| 3,733,859 | A * | 5/1973 | Wittmann | 66/193 |
| 3,965,703 | A * | 6/1976 | Barnhardt | 66/193 |
| 3,981,415 | A * | 9/1976 | Fowler et al. | 222/95 |
| 3,999,407 | A * | 12/1976 | Odham | 66/193 |
| 4,003,224 | A * | 1/1977 | Odham | 66/193 |
| 4,009,597 | A * | 3/1977 | Wall et al. | 66/193 |
| 4,044,575 | A * | 8/1977 | Krug | 66/192 |
| 4,103,485 | A * | 8/1978 | Brues | 66/192 |
| 4,244,199 | A * | 1/1981 | Rhode | 66/193 |
| 4,248,064 | A * | 2/1981 | Odham | 66/192 |
| 4,378,683 | A * | 4/1983 | Matsuda et al. | 66/193 |
| 4,733,545 | A * | 3/1988 | Weinle et al. | 66/202 |
| 4,818,316 | A * | 4/1989 | Weinle et al. | 156/88 |
| 5,125,246 | A * | 6/1992 | Shytles | 66/193 |
| 5,265,445 | A * | 11/1993 | Shytles et al. | 66/192 |
| 5,457,968 | A * | 10/1995 | McClintock et al. | 66/202 |
| 5,522,240 | A * | 6/1996 | Wall et al. | 66/192 |
| 6,446,471 | B1 * | 9/2002 | Kaplancali | 66/192 |
| 6,516,637 | B1 * | 2/2003 | Fancher et al. | 66/170 |
| 6,722,164 | B1 * | 4/2004 | Ives et al. | 66/195 |
| 6,840,066 | B2 * | 1/2005 | Dickerson | 66/192 |
| 6,984,596 | B2 * | 1/2006 | Dickerson | 442/316 |
| 7,555,922 | B1 * | 7/2009 | Berlin | 66/195 |

* cited by examiner

*Primary Examiner* — Danny Worrell
(74) *Attorney, Agent, or Firm* — Shook, Hardy & Bacon L.L.P.

(57) ABSTRACT

The subject invention relates to a warp-knit fabric and methods of constructing the fabric. The fabric includes a plurality of walewise stitch-loop chains and a weftwise elastomeric thread running in successive courses and held in place by the stitch-loop chains. The fabric may include border segments that have filling yarn disposed weftwise across the stitch-loop chains.

9 Claims, 4 Drawing Sheets

LATERALLY-STRETCHABLE KNIT FABRIC

CROSS-REFERENCE TO RELATED APPLICATIONS

This application claims the benefit of U.S. provisional patent application No. 61/149,938, filed Feb. 4, 2009, titled "Textile-Attached Seating System."

BACKGROUND

In recent years, furniture manufacturers have begun to move away from using metal coils and other attachments in sofas, chairs, and beds. In lieu of these rigid and often problematic attachment and support structures, elastomeric textiles are being utilized more frequently. Elastomeric textiles can be cut to desired lengths and fastened easily with staples. The longitudinal stretch properties associated with these textiles offers an alternative means of attaching, securing, and supporting various portions of furniture pieces. However, because these textiles stretch longitudinally, fitting them to a particular application often involves a large amount of measuring, cutting, and disposing of waste material.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Embodiments of the present invention relate to a laterally-stretchable knit fabric. In embodiments, the fabric includes an elastomeric segment extending longitudinally along the fabric that includes a plurality of walewise stitch-loop chains. The elastomeric segment also can include an elastomeric thread extending weftwise in successive courses back and forth across the segment. In embodiments, the elastomeric thread is held in place by one or more of the plurality of walewise stitch-loop chains.

Further embodiments of the present invention include methods for constructing a laterally-stretchable knit fabric. According to various embodiments, exemplary methods can include covering a first series of walewise threads with a first plurality of polyester weft yarns such that a first border segment is created that extends walewise along a first edge of the fabric and covering a second series of walewise threads with a second plurality of polyester weft yarns such that a second border segment is created that extends walewise along a second edge of the fabric. In embodiments, exemplary methods of construction further include creating a series of walewise stitch-loop chains such that an elastomeric segment is created that extends walewise along the fabric between the first and second border segments and extending an elastomeric thread back and forth across the elastomeric segment in substantially parallel successive courses.

Additional embodiments of the invention include a laterally-stretchable warp knit fabric having three or more segments. In embodiments, the fabric includes a first segment extending longitudinally along a first side of the fabric and is composed of a first plurality of walewise parallel stitch-loop chains and filling yarn extending weftwise across the first plurality of walewise parallel stitch-loop chains. A second segment can be disposed longitudinally adjacent to the first segment and can include a plurality of walewise stitch-loop chains. In embodiments, a third segment extends longitudinally adjacent to the second segment and includes a third plurality of walewise parallel stitch-loop chains and filling yarn extending weftwise across the third plurality of walewise parallel stitch-loop chains. Additionally, embodiments of the fabric include an elastomeric thread extending weftwise in successive courses back and forth across the fabric.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

Figure 1:
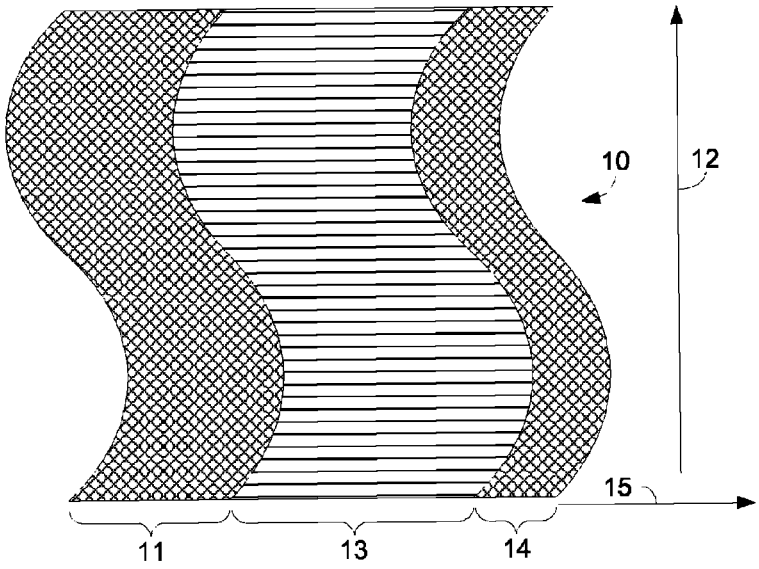
FIG. 1 is a top-plan view of a length of laterally-stretchable knit fabric in accordance with embodiments of the present invention.

Turning now to the drawings, which are not represented in scale, but rather to clearly show the various embodiments and constructions, FIG. 1 depicts a length of laterally-stretchable warp-knit fabric 10 in accordance with embodiments of the inventions. As shown, fabric 10 includes a first border segment 11 running in a longitudinal (i.e., walewise) direction 12, a second, elastomeric, segment 13 running in a walewise direction 12 and disposed adjacent to one edge of the first segment 11, and a third segment 14, which may be a second border segment, running in a walewise direction 12 and disposed adjacent an edge of the second segment 13. In embodiments, the border segments 11 and 14 are configured so that they may be attached to furniture products. Such attachment can be achieved, for example, using staples, nails, bolts, screws, clamps, or any other attachment mechanisms. In this manner, the fabric 10 can be used as an attachment medium between two portions of a furniture product, thereby providing a secure and flexible coupling between the two portions of the furniture product.

Figure 2:
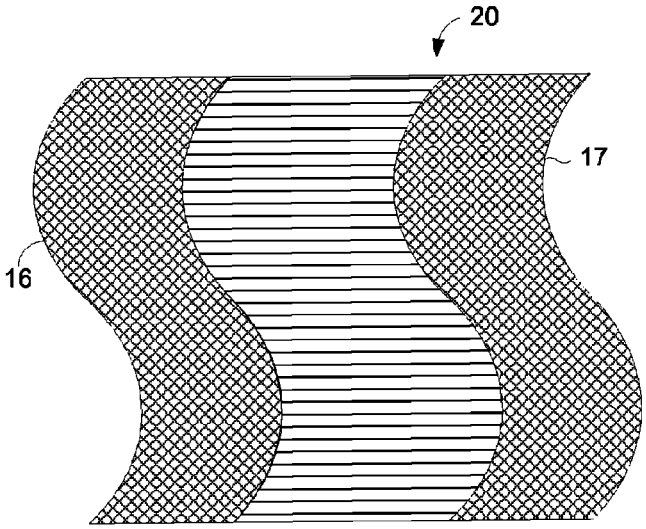
FIG. 2 is another top-plan view of a length of laterally-stretchable knit fabric in accordance with embodiments of the present invention.

In embodiments, for example, the border segments 11 and 14 can be used for attaching the fabric 10 on one side to a seat decking assembly and on the opposite side to a rail or other structure that couples the fabric to a frame of a seating product such as, for example, is described in U.S. Application No. 61/149,938, filed Feb. 4, 2009. Additionally, according to various embodiments, as illustrated in FIG. 1, the border segments 11 and 14 may have different widths. In other embodiments, as illustrated in FIG. 2, the border segments 16 and 17 of the fabric 20 may have substantially the same width.

According to embodiments of the invention, the fabric 10 can include any number of segments. For example, in some embodiments, the fabric 10 includes two border segments 11 and 14 and a number of additional, elastomeric, segments disposed there-between. In other embodiments, the fabric 10 is made of only a single segment, which may have a uniform or varied elasticity throughout.

According to embodiments, the fabric 10 is laterally-stretchable. That is, in contrast with traditional longitudinal (walewise) stretching products, the fabric 10 stretches in the lateral (i.e., weftwise) direction 15. The lateral stretchability of the fabric 10 allows for rolls of the fabric 10 to be produced such that lengths of the fabric can be cut and disposed between components of a seating product without wasting large amounts of fabric in cuttings produced while fitting the textile borders to the other components. In some embodiments, the elasticity of the second segment 13 is greater than the elasticity of either of the outside segments 11 and 14. In other embodiments, all three segments 11, 13, and 14 have similar degrees of elasticity.

Figure 3:
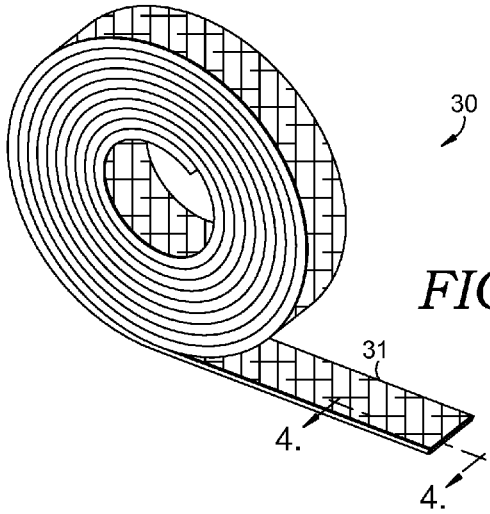
FIG. 3 depicts a perspective view of a roll of laterally-stretchable fabric in accordance with embodiments of the present invention.

Turning now to FIG. 3, a perspective view of a roll 30 of laterally-stretchable fabric 31 is depicted. The fabric 31 may be, for example, 7.6 cm wide and 30 meters in length, although other widths and lengths could be manufactured and packaged as desired. The fabric 31 can, according to embodiments, be constructed on a conventional warp-knit machine such as a Comez, which is well-known in the knitting industry.

Figure 4:
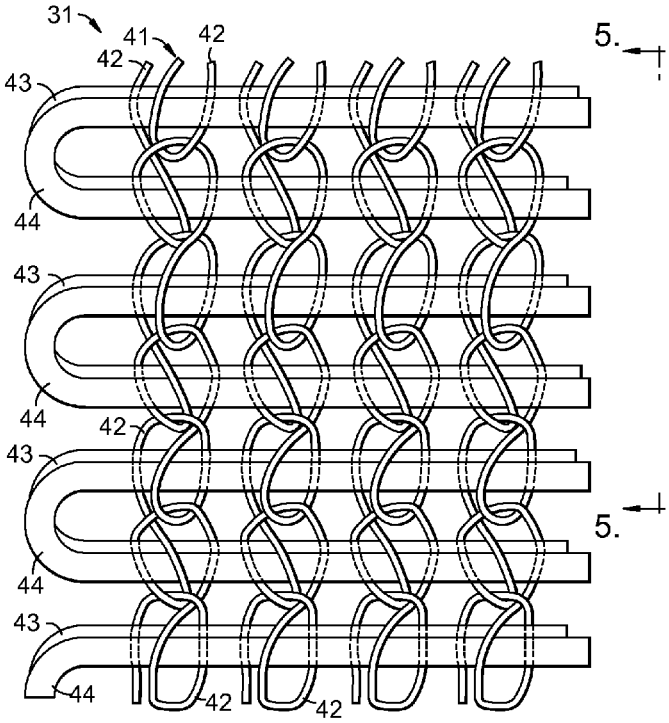
FIG. 4 depicts an enlarged top-plan view of a section of laterally-stretchable knit fabric in accordance with embodiments of the present invention.

In FIG. 4, an enlarged top-plan view of a section of the fabric 31 as shown in FIG. 3 along lines 4-4 is depicted. As seen, the fabric 31 includes a plurality of walewise parallel stitch-loop chains shown generally at 41, which are formed utilizing stitch-loop yarn 42, as described in U.S. Pat. No. 5,522,240 to Wall et al., issued Jun. 4, 1996, which is incorporated herein by reference. In an embodiment, for example, the stitch-loop yarn 42 can be a 600 denier polyester yarn. In some embodiments, a filling yarn 43 may be included as well. For example, in an embodiment, filling yarn 43 can be used in border segments of the fabric 31 to provide a stronger structure for supporting attachment to furniture products, as discussed above. Filling yarn 43 may consist, for example, of a 1200 denier polypropylene yarn of the bulk continuous filament type. In embodiments, any number of filling yarns 43 can be used.

With continued reference to FIG. 4, an elastomeric thread 44 is extended across the stitch-loop chains 41, running weftwise in successive, uninterrupted courses back and forth across the fabric, as shown. In an embodiment, the elastomeric thread 44 is covered rubber. In some embodiments, the elastomeric thread 44 extends across the entire width of the fabric 31. In other embodiments, the elastomeric thread 44 extends across some segments of the fabric, but not others.

Figure 5:
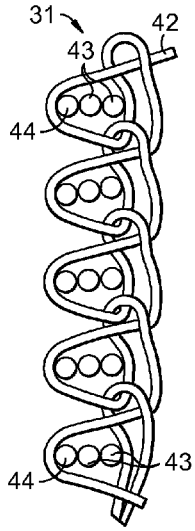
FIG. 5 depicts a side view of laterally-stretchable knit fabric in accordance with embodiments of the present invention.

FIG. 5 illustrates a side view of the fabric 31 as shown in FIG. 4 along lines 5-5 and likewise shows one example of a placement of the elastomeric thread 44 which runs in successive courses weftwise across, and is held in place by, the stitch-loop chains 41. Additionally, as illustrated, some segments of the fabric 31 may include filling yarn 43 disposed weftwise through the stitch-loop chains.

Figure 6:
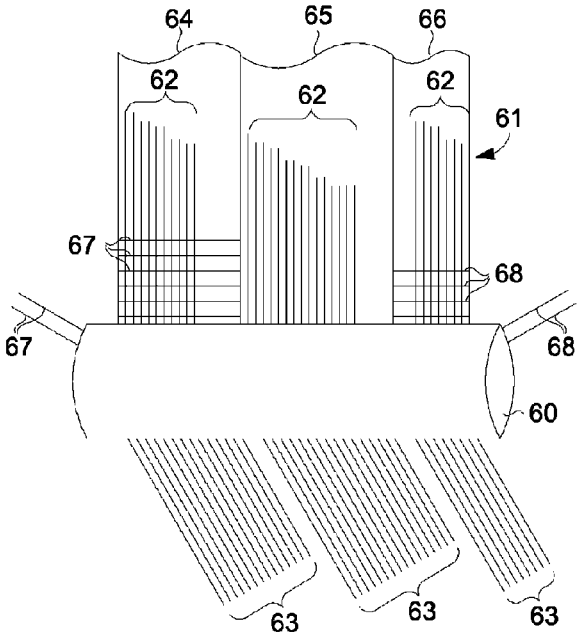
FIG. 6 depicts construction of a length of laterally-stretchable knit fabric in accordance with embodiments of the present invention.

Turning to FIG. 6, an example of construction of the laterally-stretchable warp-knit fabric 61 is depicted. As mentioned above, the fabric 61 can be formed on a conventional warp knit machine such as a Comez. Because the type of machine used to knit the fabric 61 described herein is not germane to this disclosure, a non-specific machine 60 is shown for clarity. As illustrated, the fabric 61 includes a plurality of walewise parallel stitch-loop chains shown generally at 62, which form successive courses therealong utilizing stitch-loop yarn 63. Different numbers of courses of the stitch-loop chains 62 can be used in various embodiments to provide for different widths and the like. In one embodiment, for example, a first segment 64 includes between 12 and 16 (e.g., 14) stitch-loop chains 62, a second segment 65 includes between 16 and 20 (e.g., 16) stitch-loop chains 62, and a third segment 66 includes between 6 and 10 (e.g., 9) stitch-loop chains 62.

Figure 7:
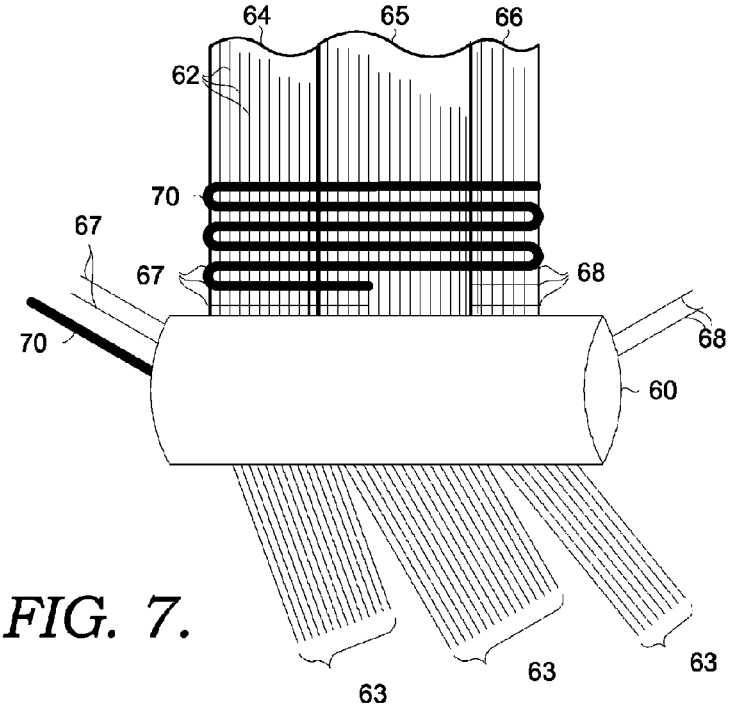
FIG. 7 depicts construction of a length of laterally-stretchable knit fabric in accordance with embodiments of the present invention.

As is further shown in FIG. 6, filling yarn 67 and 68 is inlaid in and weftwise extends across the stitch-loop chains 62 of segments 64 and 66. In embodiments, the filling yarn 67 and 68 includes high tenacity polypropylene yarn. In other embodiments, the filling yarns 67 and 68 can also be extended across the middle segment 65. With reference to FIG. 7, in embodiments of the invention, an elastomeric thread 70 is extended across the stitch-loop chains 62, running weftwise in successive, uninterrupted courses back and forth across the fabric, as shown and as further described above with reference to FIGS. 4 and 5. The elastomeric thread 70 can be, for example, a covered-rubber thread.

Figure 8:
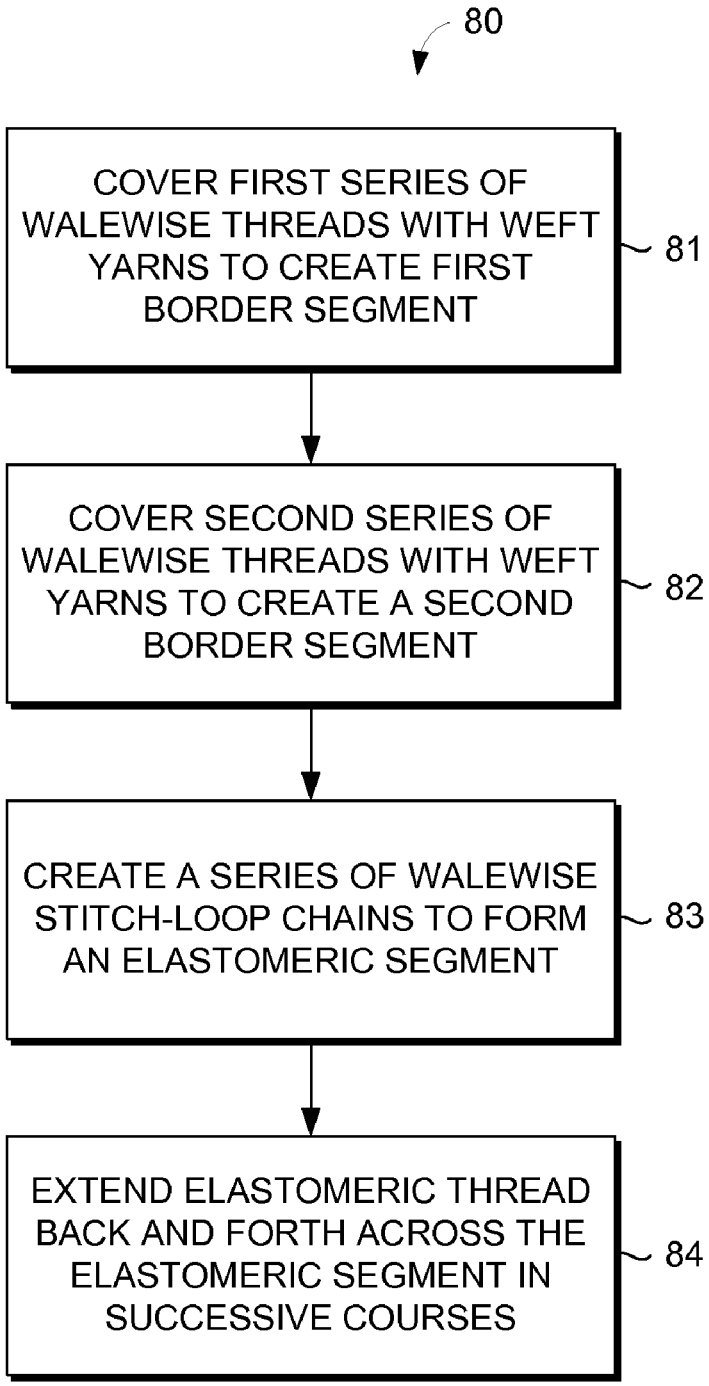
FIG. 8 depicts a flow chart that illustrates an exemplary method of constructing a laterally-stretchable warp-knit fabric in accordance with embodiments of the invention.

Turning now to FIG. 8, a flow chart is depicted that illustrates an exemplary method 80 of constructing a laterally-stretchable warp-knit fabric in accordance with embodiments of the invention. Although the flow chart illustrated in FIG. 8 depicts a series of steps, it should be understood that the order of the depicted steps is not germane to the present invention and, accordingly, the construction can be achieved using steps in any desired order. Additionally, FIG. 8 is not intended to restrict construction to the depicted steps, as it is contemplated that embodiments of the invention can include construction processes that employ only some of the depicted steps, additional steps that are not depicted, or any combination of these and other steps that may be suitable.

As illustrated in FIG. 8, at step 81, a first series of walewise threads is covered with a first plurality of polyester weft yarns such that a first border segment is created that extends walewise along a first edge of the fabric. In embodiments, the walewise threads are knitted into stitch-loop chains, which hold the weft yarns in place. At step 82, a second series of walewise threads is covered with a second plurality of polyester weft yarns such that a second border segment is created that extends walewise along a second edge of the fabric. In embodiments, the first and second border segment can be constructed such that they are substantially non-elastic. In other embodiments, the border segments may be elastic. In still further embodiments, the border segments can be constructed with any number of weft yarns such that a desired strength of the segment of fabric can be achieved.

With continued reference to FIG. 8, at step 83, a series of walewise stitch-loop chains is created such that an elastomeric segment is formed. The elastomeric segment extends walewise along the fabric between the first and second border segments. In some embodiments, a number of elastomeric segments can be disposed between the border segments. In other embodiments, weft yarns can also be included in the elastomeric segment to help control the lateral stretching of the fabric. At a final illustrative step, step 84, an elastomeric thread is extended back and forth across the elastomeric segment in substantially parallel successive courses. In some embodiments, the elastomeric thread can be extended across one or both of the border segments, as well. According to various embodiments of the invention, the successive courses of elastomeric thread are continuous. In embodiments, the elastomeric thread includes a covered-rubber thread.

The present invention has been described in relation to particular embodiments, which are intended in all respects to be illustrative rather than restrictive. Alternative embodiments will become apparent to those of ordinary skill in the art to which the present invention pertains without departing from its scope. For example, some embodiments can include modifications to the construction of the fabric to provide for more or less elasticity. For example, one embodiment further comprises pre-stretching the elastomeric thread before constructing the fabric. Other embodiments comprise applying a predetermined amount of tension to the elastomeric thread while constructing said fabric.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. A laterally-stretchable knit fabric comprising:

an elastomeric segment extending longitudinally along the fabric, wherein the elastomeric segment includes a first plurality of walewise stitch-loop chains;

an elastomeric thread extending weftwise in successive courses back-and-forth across two more of the first plurality of walewise stitch-loop chains of the elastomeric segment, the successive courses of the elastomeric thread being substantially parallel in the weftwise direction and substantially perpendicular to the first plurality of walewise stitch-loop chains, and the elastomeric thread being held in place by the plurality of walewise stitch-loop chains; and at least one border segment that extends longitudinally along a first side of the fabric adjacent to the elastomeric segment, wherein the at least one border segment includes a second plurality of walewise stitch-loop chains that hold in place a plurality of strands of filling yarn, wherein the strands of filling yarn extend weftwise across the second plurality of walewise stitch-loop chains of the at least one border segment, and further wherein the elastomeric thread further extends weftwise in successive courses back and forth across at least a portion of the second plurality of walewise stitch-loop chains of the at least one border segment.

2. The fabric of claim 1, wherein the successive courses of elastomeric thread are comprised of a continuous thread.

3. The fabric of claim 1, wherein the elastomeric thread comprises covered-rubber thread.

4. The fabric of claim 3, wherein the covered-rubber thread is under tension in the laterally-stretchable knit fabric.

5. A method for constructing a laterally-stretchable knit fabric, the method comprising:

covering a first series of walewise threads with a first plurality of polyester weft yarns such that a first border segment is created that extends walewise along a first edge of the fabric;

covering a second series of walewise threads with a second plurality of polyester weft yarns such that a second border segment is created that extends walewise along a second edge of the fabric;

creating a third series of walewise stitch-loop chains such that an elastomeric segment is created that extends walewise along the fabric between the first and second border segments; and extending an elastomeric thread back-and-forth across the third series of walewise stitch-loop chains of the elastomeric segment, the elastomeric thread extending in a plurality of successive, adjacent, weftwise courses that are substantially parallel in the weftwise direction and substantially perpendicular to the series of walewise stitch-loop chains, the successive courses of elastomeric thread providing elasticity in the lateral, weftwise direction of the elastomeric segment, wherein the successive courses of elastomeric thread are continuous.

6. The method of claim 5, wherein the elastomeric thread includes a covered-rubber thread.

7. The method of claim 6, further comprising:

pre-stretching the covered-rubber thread before constructing the fabric.

8. The method of claim 6, further comprising:

applying a predetermined amount of tension to the covered-rubber thread while constructing the fabric.

9. A laterally-stretchable warp knit fabric seat decking in an article of furniture, comprising:

a first segment extending longitudinally along a first side of the fabric, the first segment comprising a first plurality of walewise parallel stitch-loop chains and a first filling yarn extending weftwise across the first plurality of walewise parallel stitch-loop chains, the first segment being coupled to a frame of the article of furniture;

a second segment extending longitudinally adjacent to the first segment, the second segment comprising a second plurality of walewise stitch-loop chains;

a third segment extending longitudinally adjacent to the second segment, the third segment comprising a third plurality of walewise parallel stitch-loop chains and a second filling yarn extending weftwise across the third plurality of walewise parallel stitch-loop chains; and an elastomeric thread extending weftwise in successive courses back-and-forth across more than one of the second plurality of walewise stitch-loop chains, the successive courses of the elastomeric thread being substantially parallel in the weftwise direction.

* * * * *